United States Patent [19]

Telchuk, Jr. et al.

[11] 4,150,605

[45] Apr. 24, 1979

[54] DAMPER ARRANGEMENT FOR A TRAVELING SPRAY BOOTH

[75] Inventors: Steve E. Telchuk, Jr., Chicago; Rudolph J. Novota, River Grove; Thomas G. Ingham, Itasca, all of Ill.

[73] Assignee: Binks Manufacturing Company, Franklin Park, Ill.

[21] Appl. No.: 791,221

[22] Filed: Apr. 27, 1977

[51] Int. Cl.[2] ..... B05C 15/00; B05B 15/00; B08B 15/02

[52] U.S. Cl. ..... 98/115 SB; 118/326; 98/115 VM

[58] Field of Search ..... 98/115 VM, 115 SB, 49; 118/326; 137/580, 601; 202/254, 263

[56] References Cited

U.S. PATENT DOCUMENTS

| | | | |
|---|---|---|---|
| 872,618 | 12/1907 | Gebhard | 98/49 |
| 1,114,001 | 10/1914 | Ilg | 98/49 X |
| 1,631,442 | 6/1927 | Wagich | 98/49 |
| 2,761,373 | 9/1956 | Owen | 98/115 VM |

*Primary Examiner*—Carlton R. Croyle
*Assistant Examiner*—Leonard E. Smith
*Attorney, Agent, or Firm*—Gary, Juettner & Pyle

[57] ABSTRACT

A traveling paint spray booth is movable on rails beneath a stationary exhaust duct extending longitudinally of the rails. The bottom of the stationary duct is formed by a plurality of dampers pivotable to open and closed position on a hinge having its axis extending longitudinally in the duct and protected by an air deflector. The booth is provided with damper openers which engage the body portion of successive dampers to open them as the booth passes therebeneath.

3 Claims, 14 Drawing Figures

DAMPER ARRANGEMENT FOR A TRAVELING SPRAY BOOTH

BACKGROUND OF THE INVENTION

This invention relates generally to an inverted U-shaped self propelled spray booth which travels on tracks between which are supported large objects to be painted when the booth passes over them, the booth including stationary air exhaust means for removing fumes which arise from the painting operation in the booth.

More particularly, the invention relates to an arrangement of dampers, in the stationary exhaust means, the individual dampers of which must be open when the traveling spray booth is located beneath them but which must be closed at all other times.

Traveling spray booths are well known in the art, having been designed to facilitate spray painting of large objects such as, for example, locomotives or locomotive parts which, because of their size and weight, are difficult to move on a mass production basis through a stationary paint spray booth.

As is the case with all spray booths, it is necessary to provide a flow of clean air to remove spray pollutants. This is accomplished, in a traveling spray booth, by one or more blowers which move air through the booth, through appropriate filters, and through ducts which lead to one or more openings in the ceiling of the booth.

As the booth travels, the ceiling opening communicates with successive exhaust panels, or dampers, which form the bottom wall of a stationary exhaust duct extending for the full length of travel of the booth. In prior art arrangements, the exhaust panels pivot on axes extending transversely of the stationary duct. Each panel is opened at the appropriate time by a cam runway which contacts a hook formed on the end of a rod fixed to the panel and forming the pivot axis thereof. These prior art rods, however, tend to bend and break so as to at times fail to perform their function of opening the associated panel. Furthermore, because the mounting rods and the bearing points in which they rotate are positioned in the direct path of the exhaust air, they can become fouled by paint overspray, dirt and the like to the extend that the dampers remain open at all times, thereby creating obvious problems.

OBJECTS OF THE INVENTION

It is the primary object of the present invention to provide, in a traveling spray booth, a stationary duct exhaust panel arrangement which overcomes the disadvantages of prior art arrangements.

It is a specific object of this invention to provide such exhaust panels which cannot fail to open when required and which will not fail to close because of becoming fouled by paint or dirt.

DRAWINGS

These and other objects and advantages will be apparent from the following description and accompanying drawings wherein.

Figure 3:
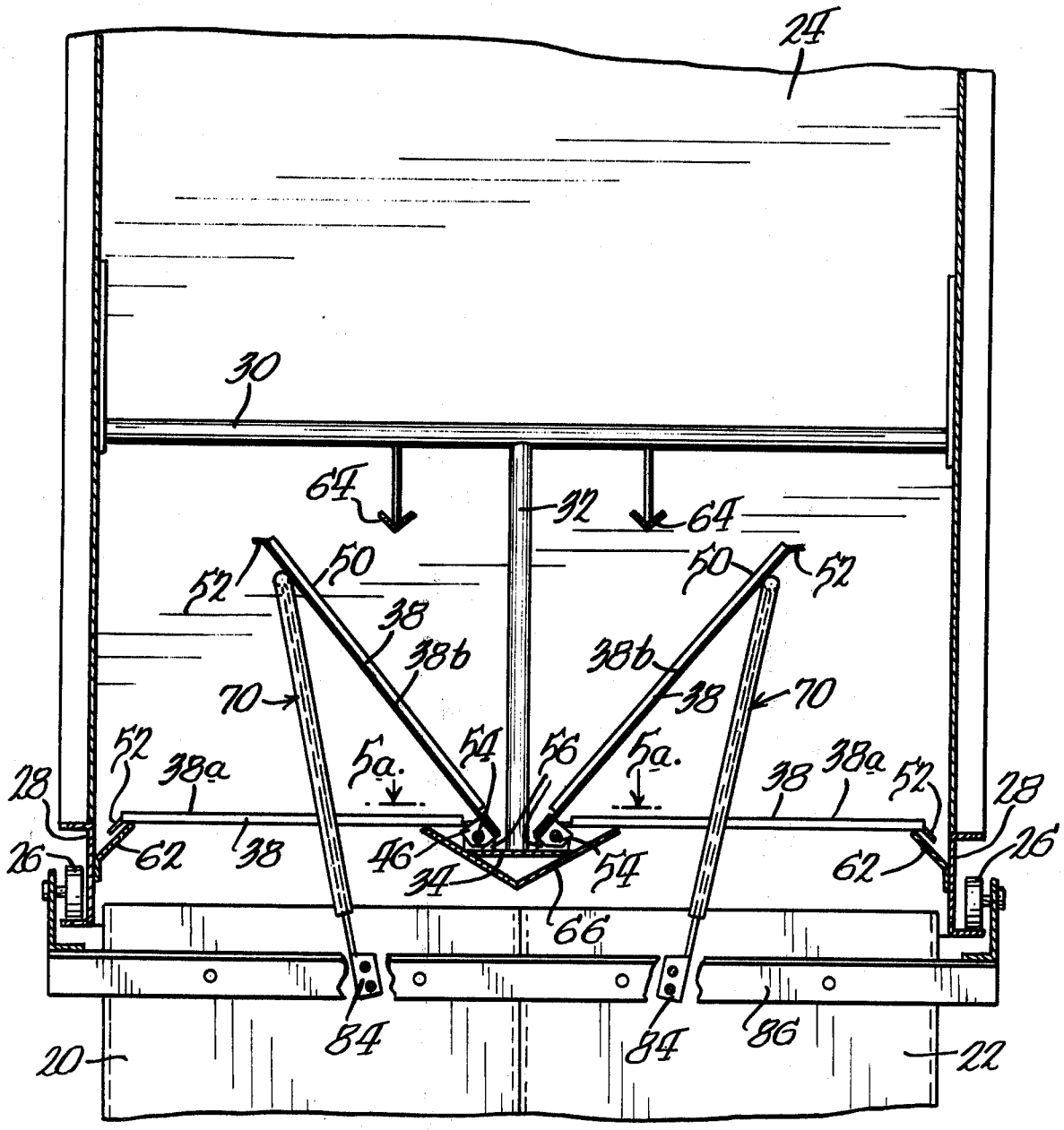
FIG. 3 is a sectional view taken at line 3—3 of FIG. 1 illustrating the novel exhaust panel construction in the stationary duct as well as the panel opening means which is carried by the spray booth.
Figure 4:
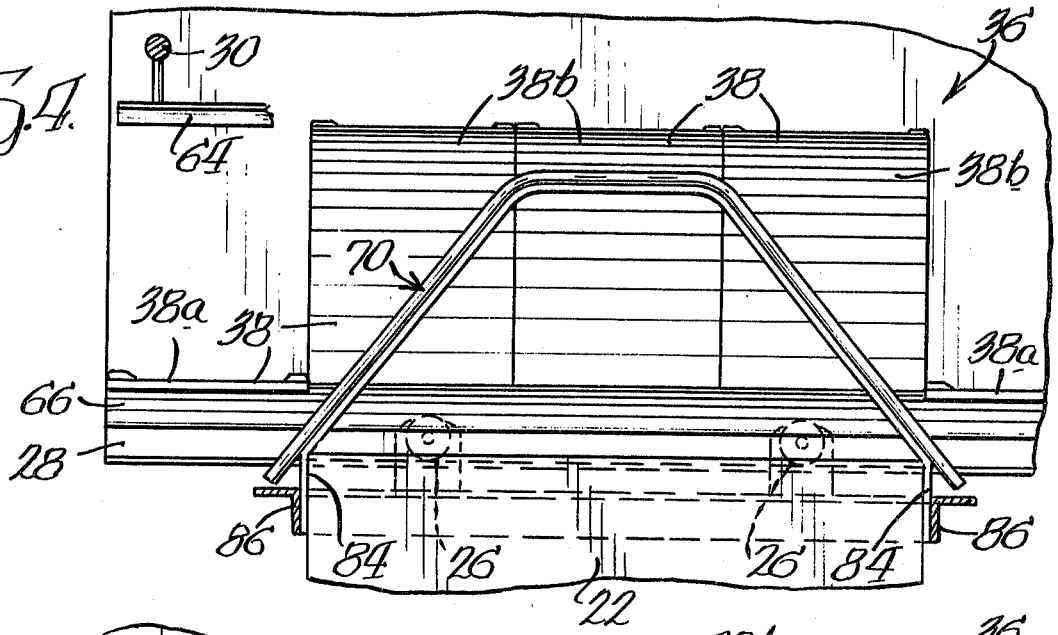
FIG. 4 is a side elevational view of the structure shown in FIG. 3 with portions removed for clarity.
Figure 4A:
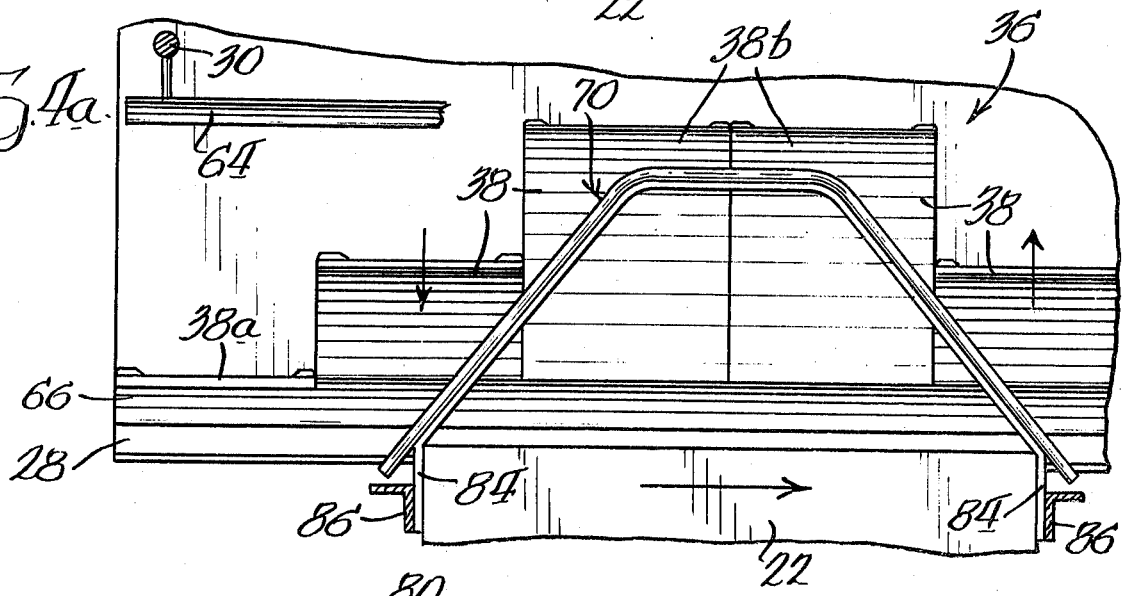
Figure 10:
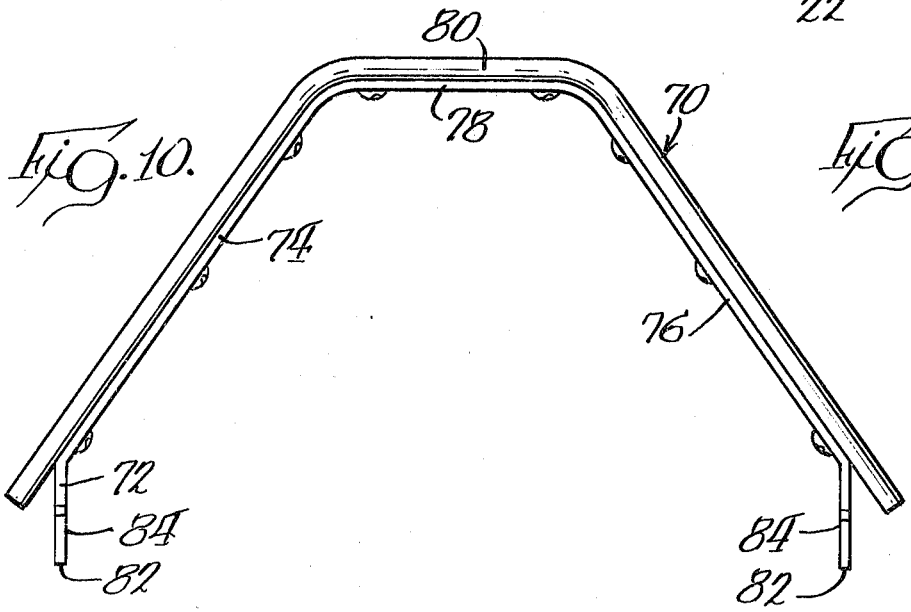
Figure 11:
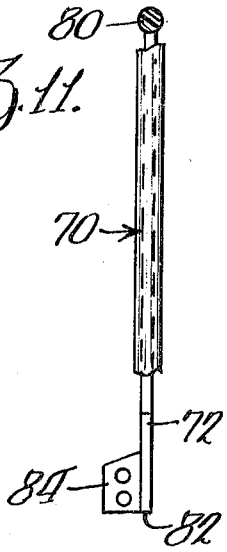
Figure 5:
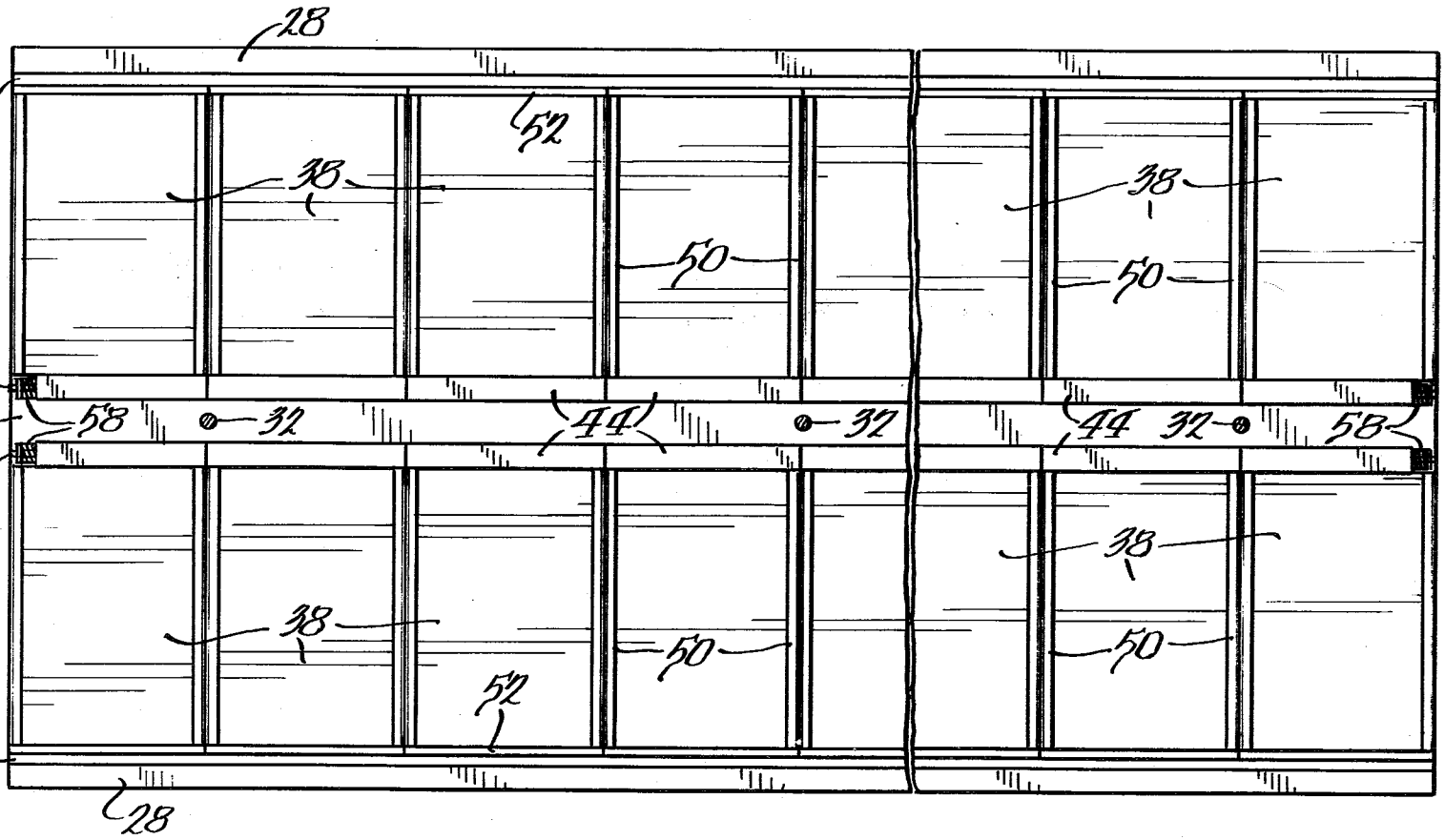
Figure 5A:
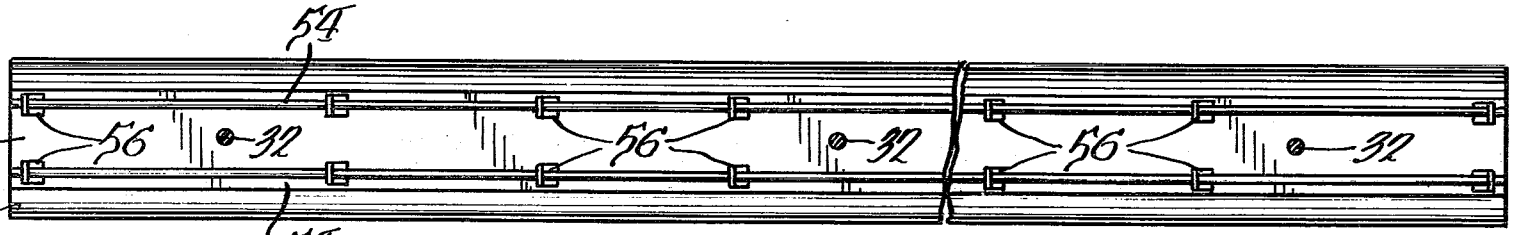
Figure 5B:
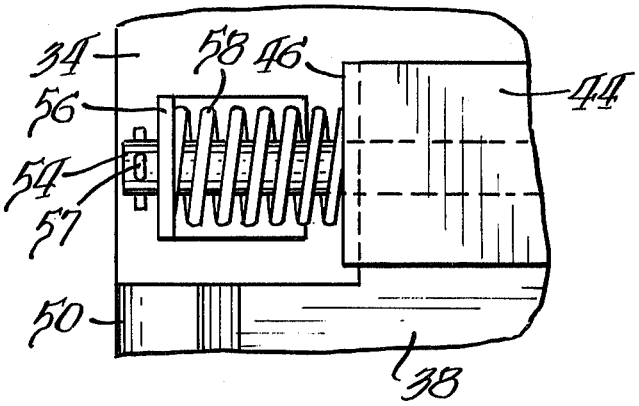
Figure 6:
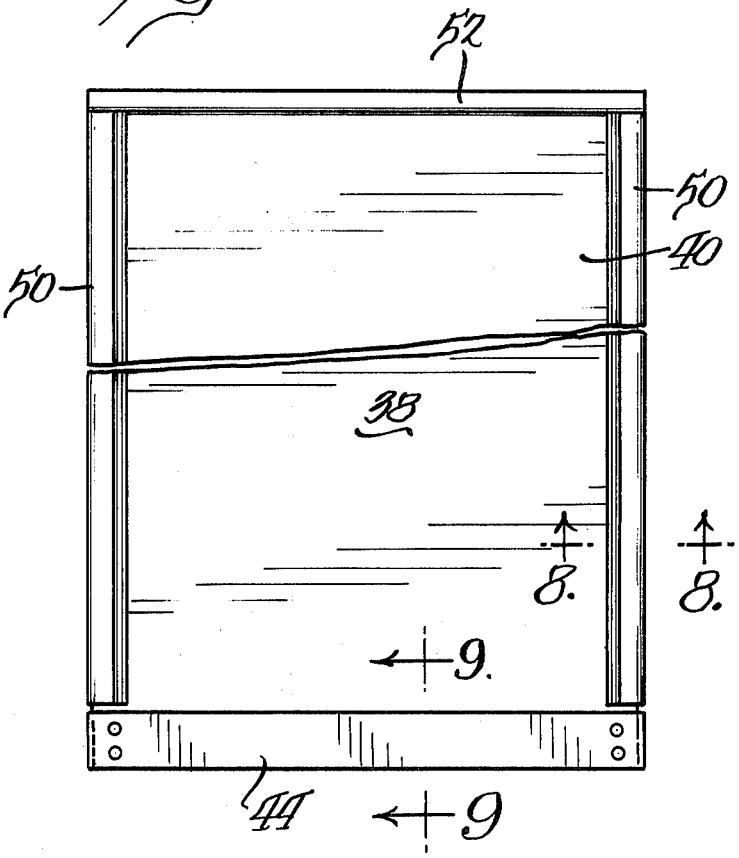
Figure 7:
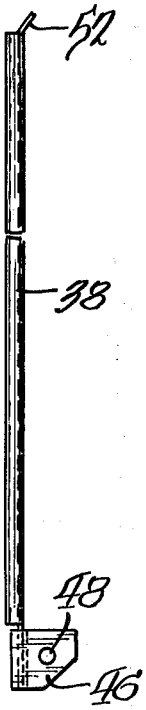
Figure 8:
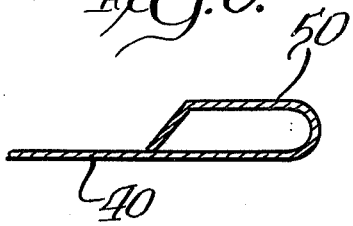
Figure 9:
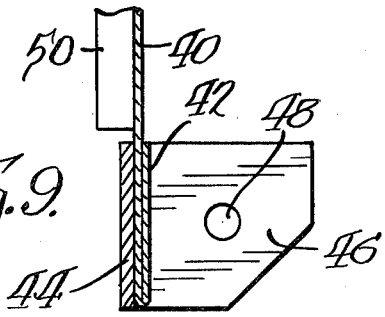

FIG. 4*a* is a fragmentary view, similar to FIG. 4 but showing the panel opening means positioned at a different location from that shown in FIG. 4;

FIG. 5 is a plan view of an air exhaust panel assembly;

FIG. 5*a* is a view taken at line 5*a*—5*a* of FIG. 3;

FIG. 5*b* is a view of the compression means to hold the dampers in touching relationship;

FIG. 6 is a plan view of the preferred embodiment of an exhaust panel;

FIG. 7 is a side view of the panel of FIG. 6;

FIG. 8 is a sectional view taken at line 8—8 of FIG. 6;

FIG. 9 is a sectional view taken at line 9—9 of FIG. 6;

FIG. 10 is an elevational view of the preferred embodiment of the panel opening rod assembly; and FIG. 11 is an end view of the rod shown in FIG. 10.

DETAILED DESCRIPTION

Figure 2:
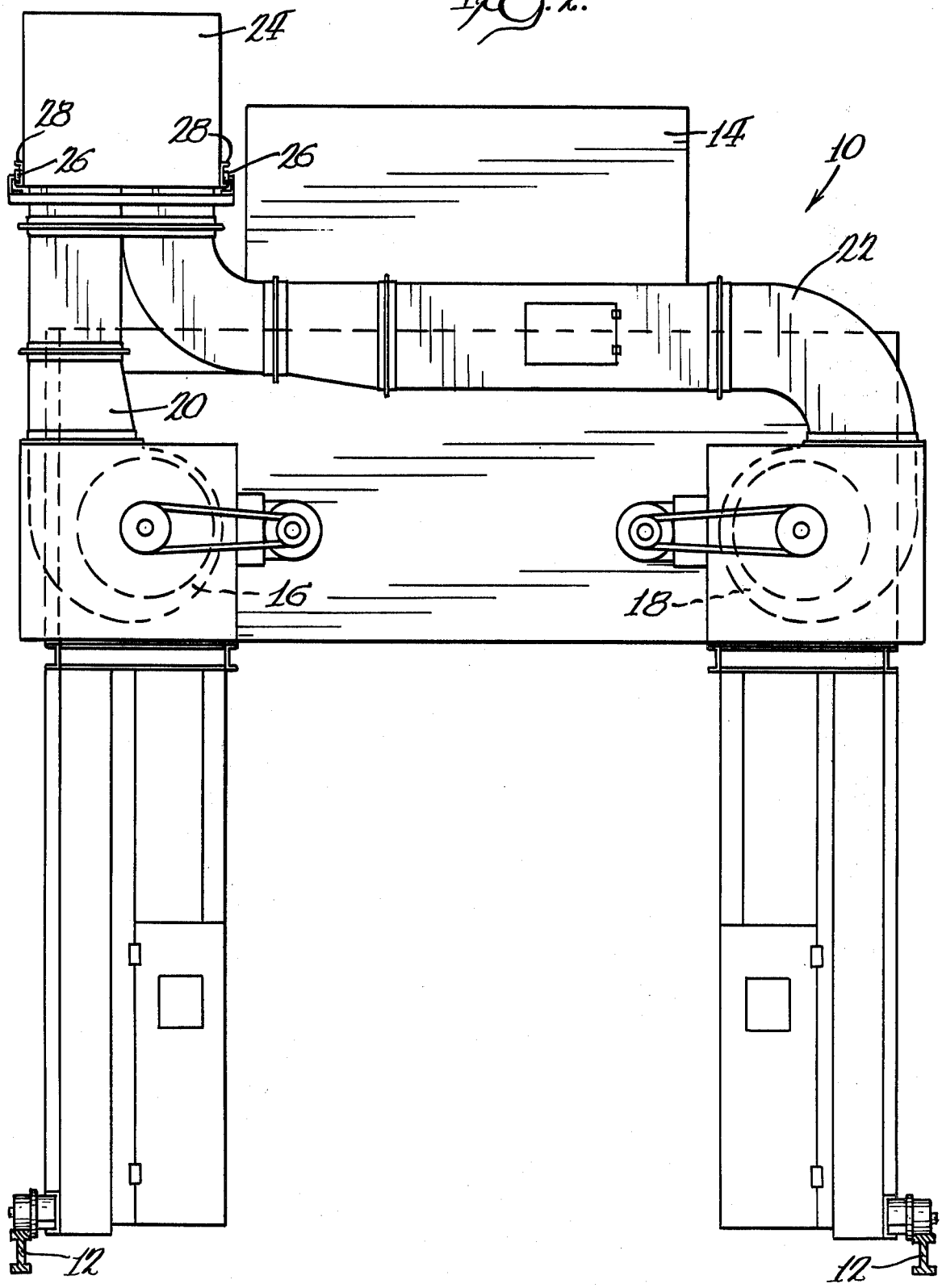
FIG. 2 is a fragmentary end view of the device of FIG. 1.

Referring to the drawings, a spray booth 10 is movable along spaced rails 12. The booth is generally inverted "U" shape as best seen in FIG. 2 so that objects to be painted may be positioned between the rails and, in effect, pass through the booth as the booth moves along the rails. Filtered replacement air is supplied by an air supply plenum 14 and is moved through the booth and exhausted by fans 16 and 18 into ducts 20 and 22.

Ducts 20 and 22 are open at their outlet ends for communication with elongated stationary exhaust duct 24.

As best seen in FIG. 3, the spray booth is provided at the outlet ends of ducts 20 and 22, with idler rollers 26 which ride in channels 28 of stationary duct 24 to insure alignment and good communication between the ducts 20, 22 and the stationary duct as the booth moves along the rails.

A pair of cross bars 30 are welded or otherwise secured to the internal walls of duct 24. Depending from each cross bar is a vertical bar 32, the bars 32 being interconnected by a mounting plate 34 extending the full length of exhaust duct 24.

The bottom of exhaust duct 24 is closed by opposed damper assemblies 36 (see also FIG. 5) which comprise a plurality of individual dampers 38, which are normally closed except when opened to provide communication between the spray booth discharge ducts and the stationary exhaust duct.

The dampers 38, as shown in FIGS. 6 through 9, comprise a flat aluminum plate body 40 having its pivotal end preferably formed with a fold or hem 42, as seen in FIG. 9, for strength and added rigidity. Overlying the hem 42 is a strap 44 having ends 46 bent at right angles and containing pivot rod openings 48.

Each side 50 of the damper 38 is curved inwardly as seen in FIG. 8, not only to give rigidity to the damper body, but also to provide curved engaging surfaces to facilitate opening and closing of adjacent dampers during operation of the spray booth. A lip 52 may be formed along the edge of the damper opposite the pivotal edge for a purpose to be explained hereinafter.

While the dampers preferably are formed of aluminum for purposes of lightness and resistance to corrosion, other materials such as stainless steel, tin, plastic, or the like, may be used if desired.

The desired number of dampers 38, in each set of dampers, are pivotally mounted, or hinged, on a rod 54 (see FIG. 5*a*) which is received through openings in a plurality of aligned angle brackets 56 which are welded to mounting plate 34. As seen in FIG. 5, the two outermost dampers of each set are notched to accommodate compression springs 58. The springs are compressed between the hinge portion of the free edge of each of the end dampers and brackets 56 as seen in FIG. 5*b* and serve to keep adjacent dampers in snug engagement. A cotter pin 57 may be utilized at each end of each rod 54 to prevent longitudinal movement of the rods.

Referring again to FIGS. 3 and 4, it will be seen that the dampers, when not vertically aligned with the spray booth, will by force of gravity remain in closed position as indicated at 38*a*, but will be pivotable to an open position, as indicated at 38*b* in a manner explained hereinafter. Longitudinally extending stop means 62 may be provided to limit downward movement of dampers 38 and to receive lip 52 in more or less sealing engagement. Angle stops 64, preferably in the form of a continuous angle, are provided to limit the amount of opening of the dampers to less than 90° so that they will be free to fall to closed position and cannot be moved to a position where they would not return by gravity to their closed position. Additionally, it is desirable to provide a deflector 66, extending for the full length of the damper assemblies, beneath the pivot rods 54. Deflector 66 diverts air, which is passing from the spray booth outlet ducts 20,22 into the stationary exhaust duct 24, away from and around the damper hinges. The hinges are thereby protected from paint or other particles impinging thereon and that might otherwise prevent free pivotal action of the dampers.

When the spray booth is in operation, there will be a constant flow of air upwardly through ducts 20 and 22. As these open-top ducts pass successive dampers in stationary duct 24, the blast of air from the ducts may of itself force open the associated dampers, pass into exhaust duct 24 and be removed therefrom by conventional exhaust fans 68 which maintain a slight negative pressure in exhaust duct 24.

However, to insure the opening of the dampers, it is desirable to provide positive damper opening means as indicated generally at 70 in FIGS. 3 and 4 and shown in detail in FIGS. 10 and 11.

The preferred damper opener 70 is shown in FIGS. 10 and 11 and, in the preferred embodiment, comprises a squaresection bar 72 having opposed inclined camming legs 74 and 76 interconnected by a generally horizontally disposed portion 78. Secured to the outer surface of bar 72 in any suitable manner is a polyethylene or other low friction material rod 80. Although not essential, the polyethylene rod, because it is softer than the dampers and has a low coefficient of friction, is desirable because it contributes to less wear, longer life and lesser maintenance of the dampers.

It will also be noted that the damper openers are operable to open the dampers at the proper time in either direction of travel of the booth along the tracks. Therefore, painting operations can be performed in both directions of travel.

The outer ends 82 of bar 72 are bent so as to be parallel as shown in FIG. 10 and are spot welded to mounting clips 84 as shown in FIG. 11.

As seen in FIG. 3, a pair of damper openers 70 are bolted or otherwise secured to a support member 86 forming a part of the exhaust portion of the spray booth. Each damper opener is positioned so as to contact the dampers of a respective longitudinal set or series generally centrally thereof and is of sufficient length and height to hold open several successive dampers simultaneously as seen in FIGS. 4 and 4*a*.

Figure 1:
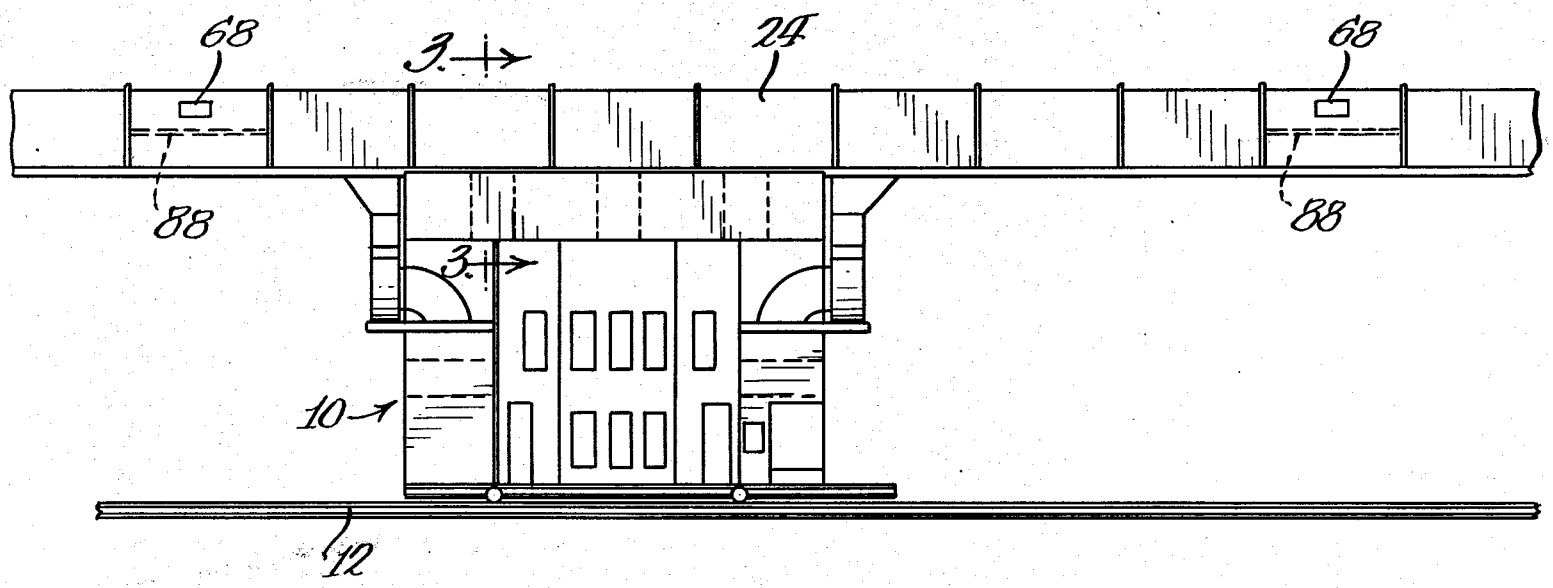
FIG. 1 is a fragmentary side elevational view of a traveling spray booth with its elongated stationary exhaust duct.

As indicated above, exhaust fans 68 in stationary duct 24 create a flow of exhaust air which at times may tend to open the dampers located beneath the fans when the traveling spray booth is positioned away from that location. It may therefore at times be desirable to position perforated diffuser plates 88 beneath the exhaust fans 68, as indicated in FIG. 1. The diffuser plates will tend to equalize the flow of air in duct 24 and eliminate low pressure areas under the exhaust fans such as tend to pull the dampers open.

The damper construction described herein overcomes the disadvantages of prior art arrangements in that it will provide longer life, less maintenance, positive damper opening when traversed by the spray booth, and a minimal tendency to remain open when not in operative association with the spray booth.

We claim:

1. In a damper arrangement for a traveling spray booth wherein the booth is movable along tracks and fresh air is flowed through the booth and exhausted through an exhaust duct at the top of the booth, and wherein a stationary exhaust duct extends lengthwise of the tracks and includes at least one exhaust fan for removing exhaust air, the bottom of said stationary duct being formed by a plurality of dampers which are normally closed and pivotable to an open position by opening means associated with the spray booth, the improvement comprising hinge means along one edge of the dampers, said hinge means extending longitudinally of the stationary duct, said dampers being pivotable on said hinge means but being normally held closed by force of gravity, damper opening means carried by the spray booth, and a perforated diffuser plate mounted in the stationary duct below the exhaust fan to balance the flow of air in the stationary duct and thereby prevent premature opening of said dampers.

2. In a damper arrangement for a traveling spray booth wherein the booth is movable along tracks and fresh air is flowed through the booth and exhausted through an exhaust duct at the top of the booth, and wherein a stationary exhaust duct extends lengthwise of the tracks and includes at least one exhaust fan for removing exhaust air from the ducts and the booth, the bottom of said stationary duct being formed by a plurality of dampers which are normally closed and pivotable to an open position by opening means associated with the spray booth, the improvement comprising hinge means along one edge of the dampers, said hinge means extending longitudinally of the stationary duct, said dampers being pivotable on said hinge means but being normally held closed by force of gravity, damper opening means carried by the spray booth and engageable with successive dampers as the spray booth moves along the tracks, thereby opening the engaged dampers to provide communication between the spray booth exhaust duct and the stationary duct, stop means for limiting the pivotal opening movement of the dampers to less than 90°, and spring means for holding said plurality of dampers in snug engagement with each other.

3. In a damper arrangement for a traveling spray booth wherein the booth is movable along tracks and fresh air is flowed through the booth and exhausted through an exhaust duct at the top of the booth, and wherein a stationary exhaust duct extends lengthwise of the tracks and includes at least one exhaust fan for removing exhaust air from the ducts and the booth, the bottom of said stationary duct being formed by a plurality of dampers which are normally closed and pivotable to an open position by opening means associated with the spray booth, the improvement comprising hinge means along one edge of the dampers, said hinge means extending longitudinally of the stationary duct, said dampers being pivotable on said hinge means but being normally held closed by force of gravity, damper opening means carried by the spray booth and engageable with successive dampers as the spray booth moves along the tracks, thereby opening the engaged dampers to provide communication between the spray booth exhaust duct and the stationary duct, and a perforated diffuser plate mounted in the stationary duct below the exhaust fan to balance the flow of air in the stationary duct and thereby prevent premature opening of said dampers.

* * * * *